US012551808B1

(12) United States Patent
Peng

(10) Patent No.: US 12,551,808 B1
(45) Date of Patent: Feb. 17, 2026

(54) THROWABLE EXPLODING WATER BALL

(71) Applicant: Shenzhen Kean Silicone Product Co., Ltd, Guangdong (CN)

(72) Inventor: Pandian Peng, Guangdong (CN)

(73) Assignee: Shenzhen Kean Silicone Product Co., Ltd, Shenzhen (CN)

( * ) Notice: Subject to any disclaimer, the term of this patent is extended or adjusted under 35 U.S.C. 154(b) by 0 days.

(21) Appl. No.: 19/227,582

(22) Filed: Jun. 4, 2025

(30) Foreign Application Priority Data

Jan. 24, 2025 (CN) ..... 202520167042.8

(51) Int. Cl.

| | |
|---|---|
| ***A63H 23/12*** | (2006.01) |
| ***A63B 39/08*** | (2006.01) |
| ***A63H 33/18*** | (2006.01) |
| *A63B 39/00* | (2006.01) |

(52) U.S. Cl.
CPC ..... *A63H 23/12* (2013.01); *A63B 39/08* (2013.01); *A63H 33/18* (2013.01); *A63B 2039/003* (2013.01)

(58) Field of Classification Search
CPC ..... A63H 23/10; A63H 23/12; A63H 33/18; A63B 39/08; A63B 2039/003
USPC ..... 446/153, 267, 473, 475
See application file for complete search history.

(56) References Cited

U.S. PATENT DOCUMENTS

| | | | | | |
|---|---|---|---|---|---|
| 4,212,460 | A * | 7/1980 | Kraft | A63B 65/00 | 473/577 |
| 5,538,456 | A * | 7/1996 | Liu | A63H 33/30 | 473/577 |
| 5,975,983 | A * | 11/1999 | Panec | A63H 33/30 | 141/114 |
| 11,358,072 | B2 * | 6/2022 | Greenwood | A63H 23/12 | |
| 11,786,835 | B1 * | 10/2023 | Xiong | A63H 23/12 | 446/267 |
| 12,337,257 | B1 * | 6/2025 | Zhang | A63H 33/18 | |
| 2022/0203256 | A1 * | 6/2022 | Chen | A63B 67/002 | |
| 2024/0286054 | A1 * | 8/2024 | Liu | A63H 23/10 | |
| 2024/0325829 | A1 * | 10/2024 | Du | A63B 43/04 | |
| 2025/0010216 | A1 * | 1/2025 | Huang | A63B 43/00 | |
| 2025/0041750 | A1 * | 2/2025 | Tao | A63H 33/18 | |
| 2025/0041755 | A1 * | 2/2025 | Chen | A63H 33/18 | |
| 2025/0090973 | A1 * | 3/2025 | Chen | A63H 23/10 | |

(Continued)

FOREIGN PATENT DOCUMENTS

| | | | |
|---|---|---|---|
| CN | 217661508 U | | 10/2022 |
| CN | 218106736 U | * | 12/2022 |
| CN | 218458638 U | * | 2/2023 |

(Continued)

*Primary Examiner* — Alexander R Niconovich

(57) ABSTRACT

A throwable exploding water ball includes a main body and a sealing cover member. The main body is provided with at least one opening, and the opening is in communication with an inner cavity of the main body. The main body and the sealing cover member are both made of an elastic soft material. The sealing cover member is connected to the main body through a connecting member and seals the opening, so that the inner cavity of the main body is able to store water. When the main body and/or the sealing cover member are deformed by an impact, an openable and closeable opening is formed between the main body and the sealing cover member, so that the water in the inner cavity of the main body is splashed out from the openable and closeable opening through the opening.

12 Claims, 9 Drawing Sheets

(56) References Cited

U.S. PATENT DOCUMENTS

2025/0256215 A1* 8/2025 Xiong ..... A63H 23/10

FOREIGN PATENT DOCUMENTS

| | | | | | |
|---|---|---|---|---|---|
| CN | 219355242 | U | * | 7/2023 | |
| CN | 117504321 | A | * | 2/2024 | ..... A63H 33/046 |
| CN | 220459861 | U | * | 2/2024 | |
| CN | 220478064 | U | * | 2/2024 | |
| CN | 221061743 | U | * | 6/2024 | |
| CN | 221637331 | U | * | 9/2024 | |
| CN | 222130975 | U | * | 12/2024 | |
| CN | 222854595 | U | * | 5/2025 | |

* cited by examiner

THROWABLE EXPLODING WATER BALL

CROSS REFERENCE TO RELATED APPLICATIONS

The present application claims the benefit of Chinese Patent Application No. 2025201670428 filed on Jan. 24, 2025, the contents of which are incorporated herein by reference in their entirety.

TECHNICAL FIELD

The present application relates to the technical field of water-playing toys, in particular to a throwable exploding water ball.

BACKGROUND TECHNOLOGY

As people's living standards improve, various entertainment activities and toy products are becoming more and more abundant. Among them, water toys, as an important part of summer outdoor activities, are loved by consumers, especially children. Among many water toys, water balls have become a popular choice in water activities because of their simplicity, ease of use and strong interactivity.

The common water balls on the market are mainly divided into two categories: disposable water balls and reusable water balls. Disposable water balls are usually made of film materials and are discarded after use, resulting in a waste of resources; while reusable water balls are made of elastic materials and can be used multiple times, which is more environmentally friendly and economical.

Chinese patent CN217661508U discloses a toy water ball, including a first carrier and a second carrier, wherein one end of the first carrier is connected to the second carrier by a connecting piece. The first carrier and the second carrier are folded in half with the connecting piece as a folding point and interlocked with each other to form a water ball body with a closed water-carrying cavity. The first carrier and the second carrier are fixed by a snap-fit structure, and the first carrier and the second carrier are separated and opened by applying pressure to the water ball body.

Chinese patent CN222130975U discloses a toy water ball, including a shell, a cover and a connecting column. The shell and the cover are both made of flexible materials. The shell defines a water storage cavity and an opening which connects the water storage cavity with the external space of the shell. The cover is installed at the opening, and the outer contour of the cover is larger than the outer contour of the opening so that the cover can seal the water storage cavity. One end of the connecting column is installed on the cavity wall of the water storage cavity away from the opening, and the other end is connected to the cover.

Existing water ball products generally have a small water capacity and cannot meet the needs of long-term games. Users need to frequently go back and forth to the water source for replenishment, which greatly reduces the continuity and fun of the game. The explosion effect of the water ball upon impact is not ideal, and the water spray is not concentrated and powerful enough, which reduces the excitement and interactivity of the game.

Therefore, there is an urgent need for a throwable exploding water ball with sufficient water capacity, good sealing performance, significant exploding effect and simple structure to improve entertainment and user experience of water games.

SUMMARY OF THE DISCLOSURE

The purpose of the present disclosure is to provide a water ball with reasonable structure and throwable exploding function in view of the defects and shortcomings of the prior art.

In order to achieve the above object, the present application adopts the following technical solutions:

The throwable exploding water ball described in the present application includes a main body and a sealing cover member. The main body is provided with at least one opening, and the opening is in communication with an inner cavity of the main body. The main body and the sealing cover member are both made of an elastic soft material, the sealing cover member is connected to the main body through a connecting member and seals the opening, so that the inner cavity of the main body is able to store water. When the main body and/or the sealing cover member are deformed by an impact, an openable and closeable opening is formed between the main body and the sealing cover member, so that the water in the inner cavity of the main body is splashed out from the openable and closeable opening through the opening.

According to the above solution, the connecting member includes a connecting piece. Two ends of the connecting piece are respectively connected to the opening of the main body, and a middle portion of the connecting piece is connected to a center of the sealing cover member. Or, the connecting piece is extended into the inner cavity of the main body, one end of the connecting piece is connected to an inner wall of the main body, and another end of the connecting piece is connected to the center of the sealing cover member.

According to the above solution, the connecting member includes at least two connecting pieces. One end of each of the connecting pieces is connected to the opening of the main body, and another end of each of the connecting pieces is connected to the sealing cover member.

According to the above solution, the connecting member further includes a dome. The dome is provided above and concentrically with the opening, and the sealing cover member is fixedly connected to the dome. At least two of the connecting pieces are arranged at equal angular intervals around the dome, one end of each of the connecting pieces is connected to the opening of the main body, and another end of each of the connecting pieces is connected to the dome.

According to the above solution, the dome is provided with a through hole, the sealing cover member is provided with a nail anchor, and the nail anchor is passed through the through hole so as to fixedly connect the sealing cover member to the dome.

According to the above solution, the connecting pieces and the main body are integrally formed, and the connecting pieces are fixedly connected to the sealing cover member by riveting, hot melting or bonding.

According to the above solution, the opening is provided with an inwardly extending liner ring and the lower ends of the connecting pieces are connected to the liner ring.

According to the above solution, a foot is provided between the lower ends of the connecting pieces and the liner ring.

According to the above solution, a first reinforcing rib is provided on an inner sidewall of each of the connecting pieces, and the first reinforcing rib is provided along a length direction of each of the connecting pieces.

According to the above solution, a plurality of second reinforcing ribs are provided on the main body, and the plurality of second reinforcing ribs are disposed around the main body in sequence and at intervals.

According to the above solution, the main body includes two hemispherical shells, at least one of the hemispherical shells is provided with the opening, and the two hemispherical shells are matched and connected to form the main body which is spherical in shape.

According to the above solution, an equatorial ring is provided on an inner wall of the main body, the equatorial ring is formed on one of the hemispherical shells, the equatorial ring covers the connection seam between the two hemispherical shells, and the equatorial ring is fixedly connected to another one of the hemispherical shells by a hot melting or bonding process.

According to the above solution, the main body has a cross-section H intersecting therewith, and the opening is opened on the main body along the cross-section H. The cross-section H is parallel to a horizontal reference plane. The distance between the cross-section H and the horizontal reference plane is less than a diameter of the main body, and the distance between the cross-section H and the horizontal reference plane is greater than or equal to a radius of the main body.

According to the above solution, the sealing cover member is a circular disc structure, an arc height L is provided between an edge of the sealing cover member and its center, and a diameter of the sealing cover member is greater than a diameter of the opening.

The beneficial effects of the present disclosure are as follows: the present disclosure has a reasonable structure. An opening can be formed by squeezing the main body or flipping the cover, so that water can be poured into the main body through the opening. The water capacity is larger. After the inner cavity of the main body is filled with water, the whole body can withstand a certain pressure without leaking, so that the user can play away from the water source. When hitting an opponent, the impact force causes the main body and the cover to deform, and water is splashed out from the opening, which is entertaining.

1. main body; 2. sealing cover member; 3. connecting piece; 11. opening; 12. openable and closeable opening; 13. liner ring; 14. second reinforcing rib; 15. hemispherical shell; 16. equatorial ring; 21. nail anchor; 31. dome; 32. through hole; 33. foot; 34. first reinforcing rib.

Detailed Embodiments

The technical solution of the present disclosure is described below in conjunction with the accompanying drawings and embodiments.

EMBODIMENT 1

As shown in FIGS. 1-3 and 9, the throwable exploding water ball described in the present application includes a main body 1 and a sealing cover member 2. The main body 1 is provided with at least one opening 11, and the opening 11 is in communication with an inner cavity of the main body 1. The main body 1 and the sealing cover member 2 are both made of an elastic soft material. The sealing cover member 2 is connected to the main body 1 through a connecting member and seals the opening 11, so that the inner cavity of the main body 1 is able to store water. When the main body 1 and/or the sealing cover member 2 are deformed by an impact, an openable and closeable opening 12 is formed between the main body 1 and the sealing cover member 2, so that the water in the inner cavity of the main body 1 is splashed out from the openable and closeable opening 12 through the opening 11.

The sealing cover member 2 covers the opening 11 and forms a hollow sphere with the main body 1. The cavity in the main body 1 can be used to hold water. The sealing cover member 2 is elastic and can fit to the outer wall of the opening 11 of the main body 1 to prevent water leakage. When the user throws the main body 1 at an opponent during play, the water in the main body 1 will not spill out.

Specifically, the main body 1 and the sealing cover member 2 are made of silicone material, which meets the safety standards of toy products. In particular, the sealing cover member 2 made of silicone can better fit the main body 1 to prevent water leakage.

Figure 9:
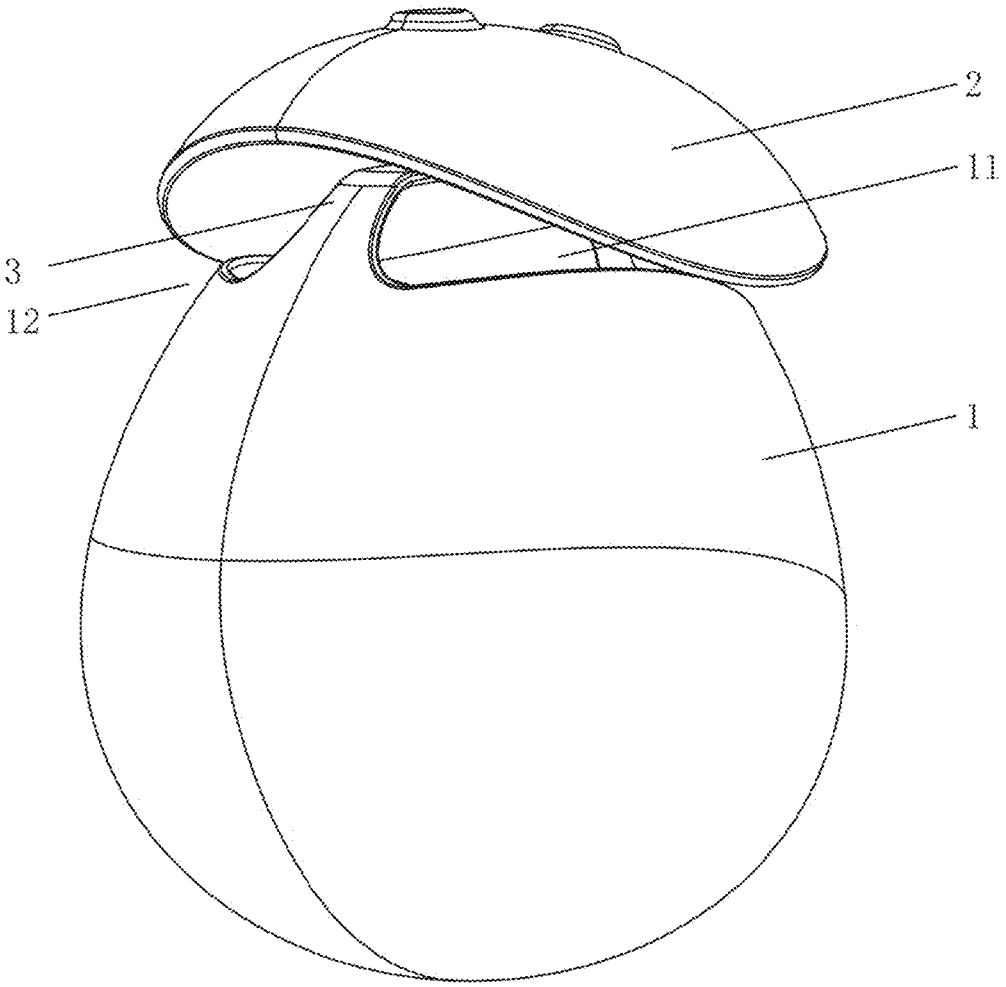
FIG. 9 is a schematic structural diagram of the present application when the openable and closeable opening is formed by force when filled with water.

Further, as shown in FIG. 9, the user can hold the main body 1 and lightly squeezes the main body 1 and/or the sealing cover member 2 to deform it. A gap is generated between the main body 1 and the sealing cover member 2 to form an openable and closeable opening 12. At this time, water can be poured into the main body 1. After it is full, the main body 1 and/or the sealing cover member 2 are released. The water pressure inside the main body 1 and its own elasticity make the two automatically restore their original shapes. The openable and closeable opening 12 is concealed. The sealing cover member 2 closes the opening 11 again to prevent water from spilling out. Compared with the prior art, the present disclosure is easier to add water, convenient to use, and can effectively speed up the game rhythm and enhance entertainment.

Of course, the user can also directly flip the sealing cover member 2 outward to expose the opening 11 in order to fill water, and then flip the sealing cover member 2 back after filling water. The sealing cover member 2 can directly close the opening 11 under the action of elasticity.

When the main body 1 hits an opponent, the main body 1 and the sealing cover member 2 are deformed by the impact. The openable and closeable opening 12 appears again, or the sealing cover member 2 is directly deformed and flips outward from the main body 1 to form a flip, and the water in the main body 1 can be splashed out from the openable and closeable opening 12 to wet the opponent.

In this embodiment, the main body 1 is made of silicone material, which has good elasticity and flexibility, and can be deformed when impacted by external force. It can return to its original shape after the external force is gone. The main body 1 is spherical in structure. It may have a diameter of about 8 cm and a wall thickness of about 2 mm, and can hold about 200 ml of water. The surface of the main body 1 is smooth, which is convenient for grasping and throwing.

Figure 6:
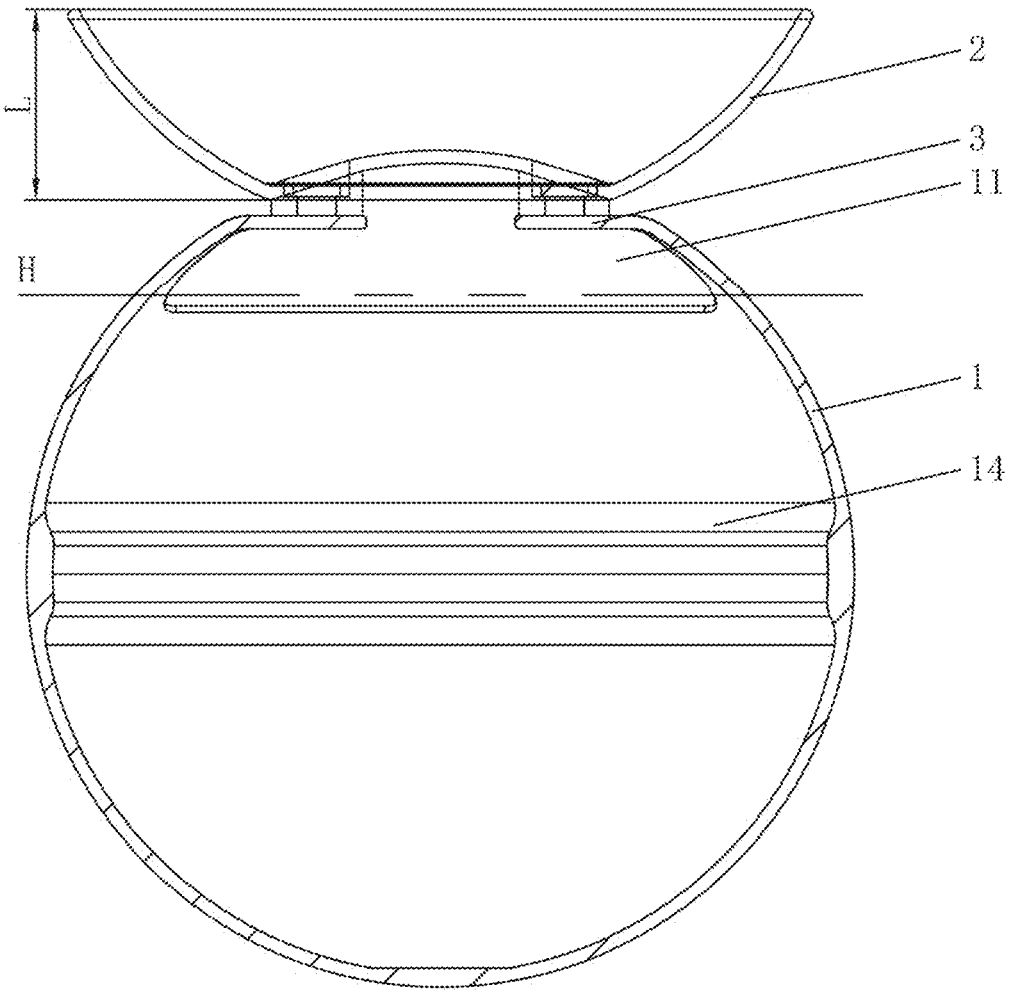
FIG. 6 is a schematic cross-sectional view of the structure of Embodiment 2 of the present application.

As shown in FIG. 6, the sealing cover member 2 is a circular disc. An arc height L is provided between an edge of the sealing cover member 2 and its center, and the diameter of the sealing cover member 2 is greater than the diameter of the opening 11. The sealing cover member 2 is also made of silicone material, with a thickness of about 1.5 mm and similar elastic properties to the main body 1.

The sealing cover member 2 can be a partial sphere cut off from the main body 1 along the opening 11, so the sealing cover member 2 has an arc height L that can adapt to the shape of the main body 1, so that it can better fit the main body 1 and seal the opening 11. The diameter of the sealing cover member 2 can be larger than the diameter of the opening 11. The sealing cover member 2 and the main body 1 may partially overlap. The overlapping surface between the two is annular, and the width of the annular overlapping surface can be greater than 0.5 cm to ensure the sealing. In order to improve the fit of the sealing cover member 2 relative to the main body 1, the sealing between the two can be further improved by increasing the arc height L. Furthermore, the diameter of the sealing cover member 2 can be larger than the diameter of the opening 11. This ensures that the sealing cover member 2 can always completely cover the opening 11 and that there is no water leakage even if it deviates from the center by a certain distance.

As shown in FIG. 6, the sealing cover member 2 is a circular disc structure, and there is an arc height L between the edge of the sealing cover member 2 and its center. This arc design enhances the sealing performance of the sealing cover member 2. At the same time, it is easier to form an opening 12 on the main body 1 when impacted. The arc height L is about 5 mm. This height has been tested many times and can ensure that while ensuring the sealing performance, the water pressure inside the main body 1 will radially impact the sealing cover member 2 when the water ball hits a target, so that the sealing cover member 2 as a whole flips out from the main body 1 but does not fall off, which is convenient for reuse. When the main body 1 is impacted by the throwing, the water in the main body 1 will impact the flipped sealing cover member 2, forming a circular throwing surface to ensure that the opponent is hit and wet, thereby obtaining a better entertainment effect.

A plurality of second reinforcing ribs 14 are provided on the main body 1, and the plurality of second reinforcing ribs 14 are disposed around the main body 1 in sequence and at intervals. Usually, the second reinforcing ribs 14 are arranged on the inner wall of the main body 1. The second reinforcing ribs 14 can improve the strength of the main body 1, ensure the structural strength of the main body 1 after water is filled in the main body 1, and make the main body 1 after water is filled remain stable when thrown.

As shown in FIG. 6, the main body 1 has a cross-section H intersecting therewith, and the opening 11 is opened on the main body 1 along the cross-section H. The cross-section H is parallel to a horizontal reference plane. The distance between the cross-section H and the horizontal reference plane is less than a diameter of the main body 1, and the distance between the cross-section H and the horizontal reference plane is greater than or equal to a radius of the main body 1. The cross section H mainly affects the opening position of the opening 11. The closer the opening 11 is to the center of the main body 1 and the larger the diameter of the opening 11, the better the water exploding effect. When the cross section H is set at the radius height of the main body 1, the water exploding effect of the openable and closeable opening 12 is the best.

The position of the cross section H and the opening 11 can be adjusted between the radius and the diameter of the main body 1 to obtain better entertainment. Preferably, the distance between the cross section H and the reference plane is less than or equal to ¾ of the diameter of the main body 1, and the distance between the cross section H and the reference plane is greater than or equal to ⅔ of the diameter of the main body 1.

The connecting member includes a connecting piece 3. Two ends of the connecting piece 3 are respectively connected to the opening 11 of the main body 1, and a middle portion of the connecting piece 3 is connected to a center of the sealing cover member 2. That is, the connecting piece 3 is arranged across the opening 11, so that the two ends of the connecting piece 3 are respectively connected to the opening 11 of the main body 1. The sealing cover member 2 is concentrically arranged with the opening 11, so that the middle part of the connecting piece 3 is connected to the center of the sealing cover member 2, and the sealing cover member 2 can cover the opening 11.

Figure 1:
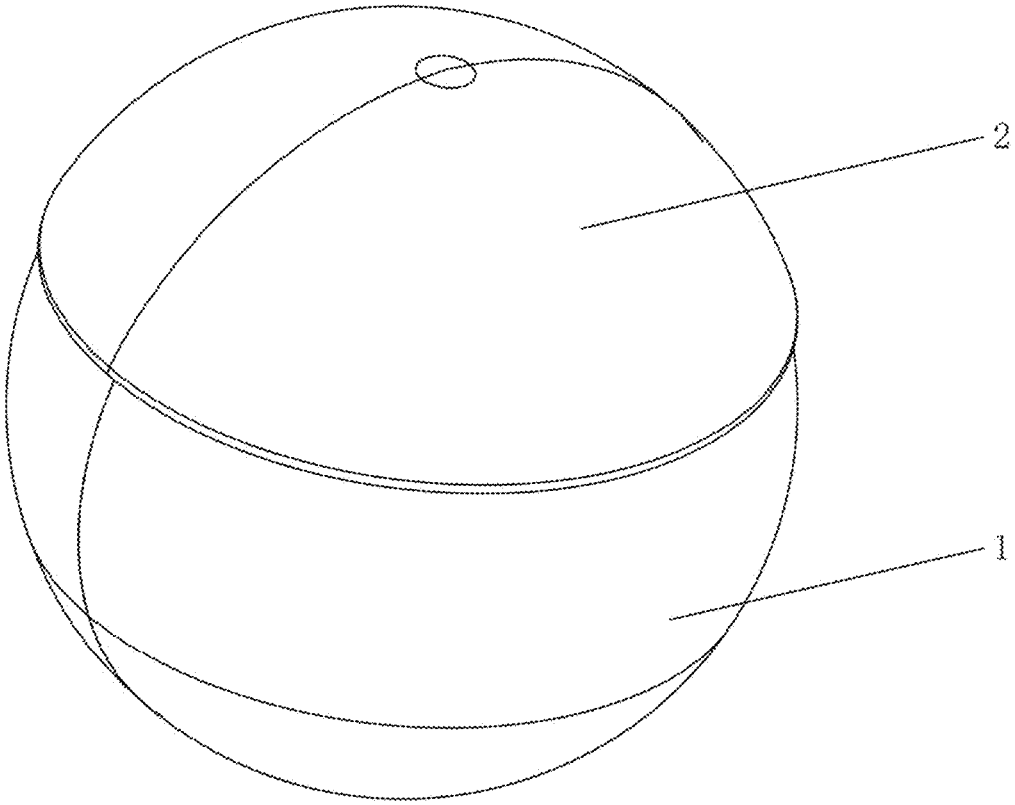
FIG. 1 is a schematic diagram of the overall structure of Embodiment 1 of the present application.
Figure 2:
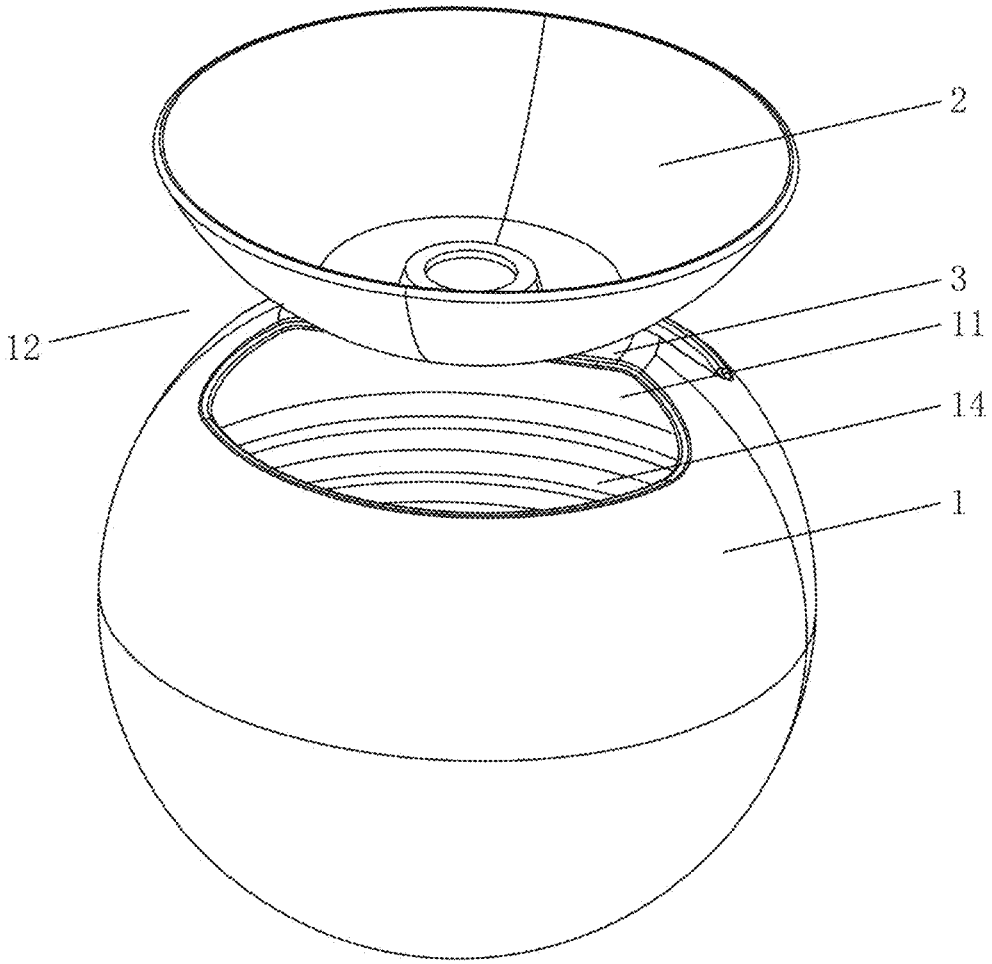
FIG. 2 is a schematic diagram of the connection between the connecting piece and the sealing cover member of Embodiment 1 of the present application.

As shown in FIG. 2, preferably, the connecting piece 3 and the main body 1 may be integrally formed. The connecting piece 3 may be fixedly connected to the sealing cover member 2 by riveting, hot melting or bonding. The connection between the connecting piece 3 and the sealing cover member 2 can be made by conventional processes, including riveting, hot melting, or bonding. The connecting piece 3 fixes the sealing cover member 2 on the main body 1, so that the water ball can be quickly and conveniently refilled with water for use, thereby speeding up the game rhythm.

Figure 3:
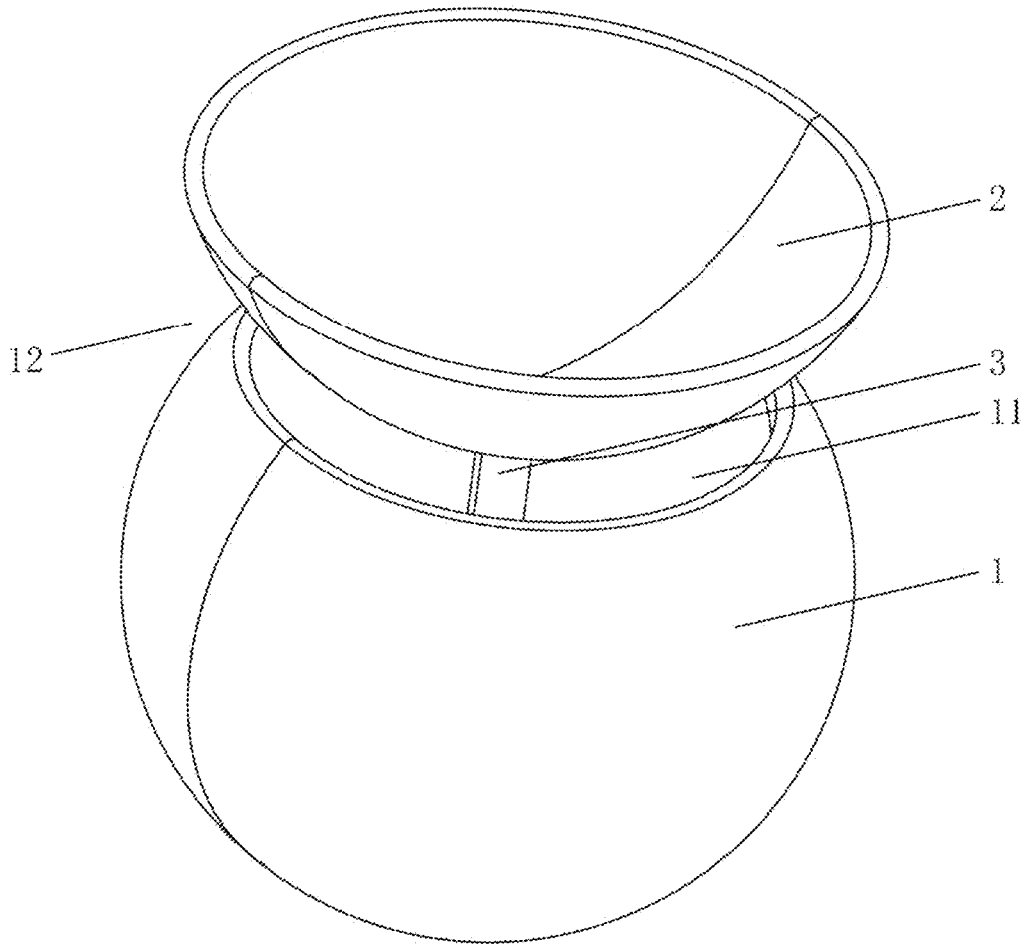
FIG. 3 is a schematic diagram of another embodiment of the connecting piece and the sealing cover member of Embodiment 1 of the present application.

As shown in FIG. 3, in this embodiment, the connecting piece 3 may be a straight rod. The connecting piece 3 is extended into the inner cavity of the main body 1. One end of the connecting piece 3 is connected to an inner wall of the main body 1, and the other end of the connecting piece 3 is connected to the center of the sealing cover member 2. The connecting piece 3, the main body 1 and the sealing cover member 2 may be connected by riveting, hot melting or bonding.

EMBODIMENT 2

Figure 4:
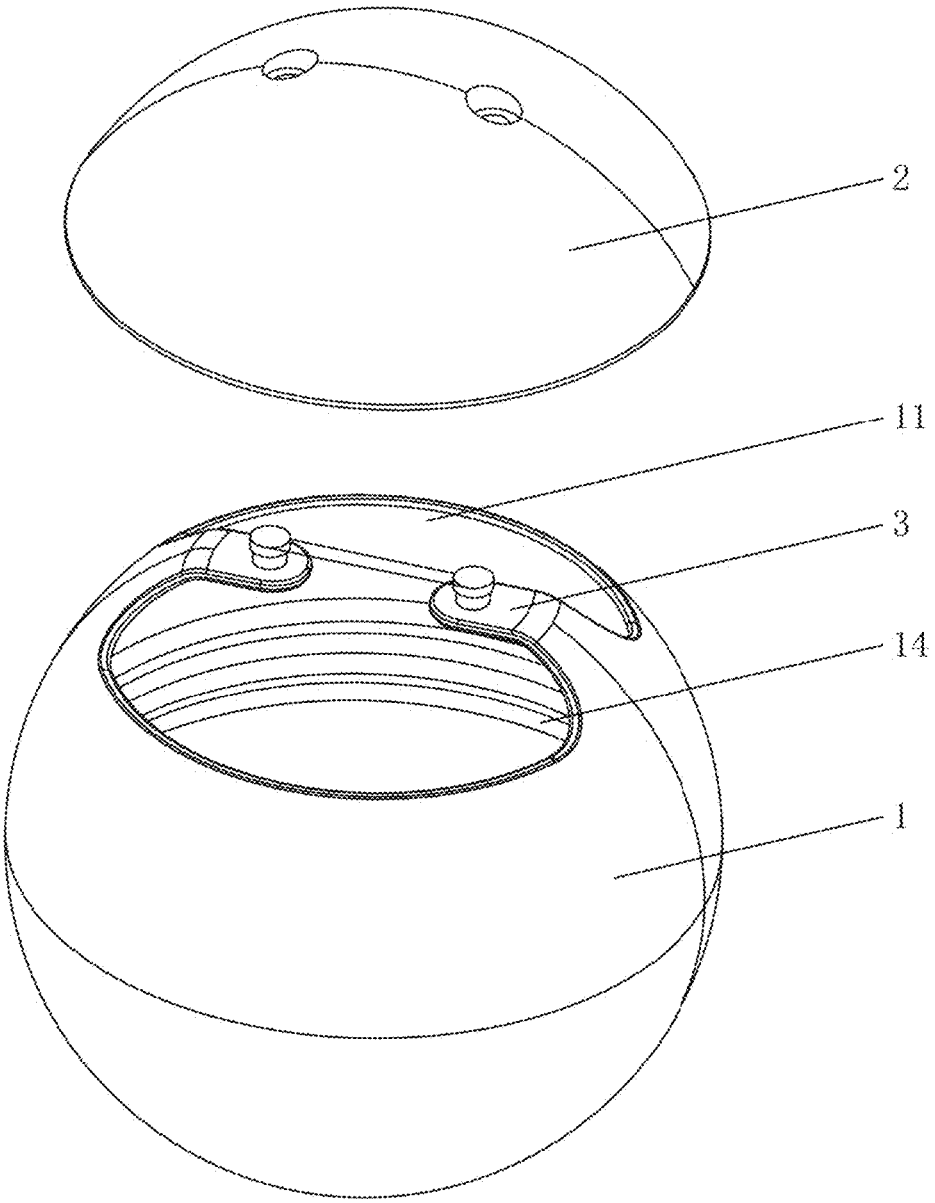
FIG. 4 is a schematic diagram of the disassembled structure of Embodiment 2 of the present application.
Figure 5:
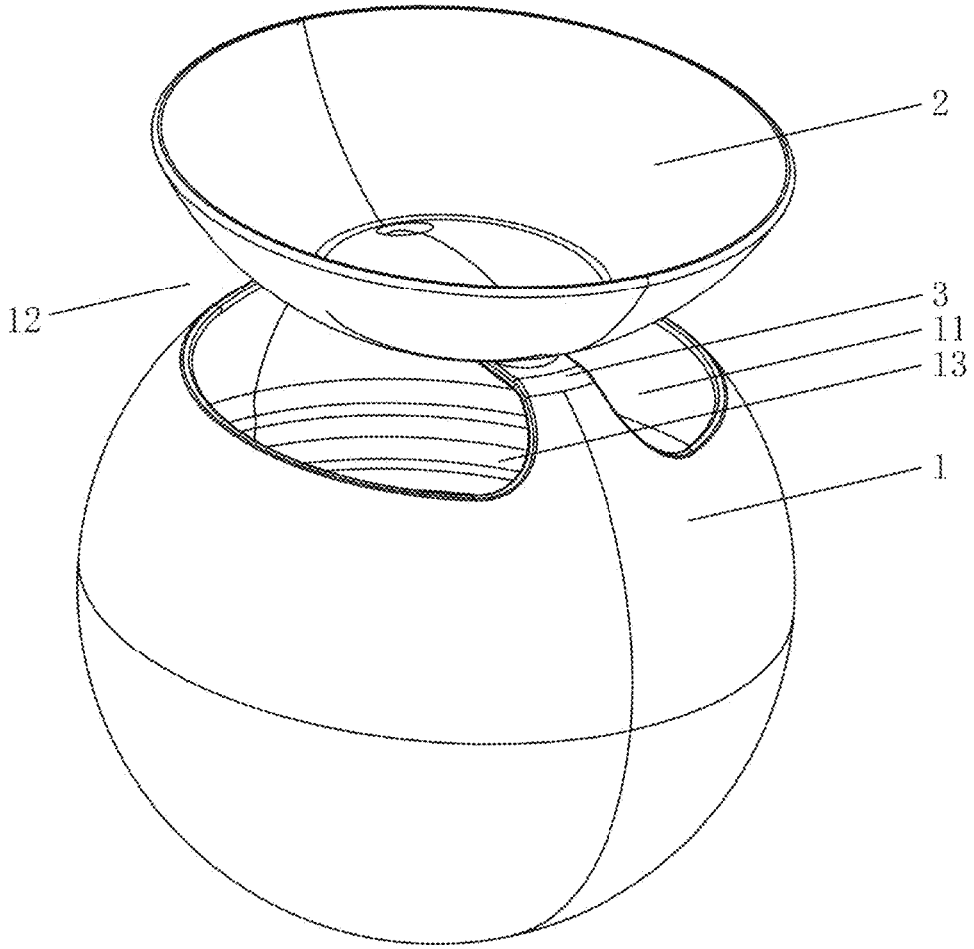
FIG. 5 is a schematic diagram of the assembled structure of Embodiment 2 of the present application.

As shown in FIGS. 4-6, the difference between this embodiment and Embodiment 1 is that the connecting member includes at least two connecting pieces 3. One end of each of the connecting pieces 3 is connected to the opening 11 of the main body 1, and the other end of each of the connecting pieces 3 is connected to the sealing cover member 2. The connecting pieces 3 are used to fix the sealing cover member 2 at the opening 11 and prevent the sealing cover member 2 from being displaced. This can ensure that the sealing cover member 2 completely covers the opening 11 and thus closes the inner cavity of the main body 1. The elasticity of the connecting pieces 3 and the sealing cover member 2 enables the sealing cover member 2 to automatically return to its original position, thereby closing the opening 11 and preventing the water inside the main body 1 from spilling out.

It can be understood that when there are two connecting pieces 3, in order to ensure the stability of the sealing cover member 2 at the opening 11, i.e., to be centrally arranged on the opening 11, the two connecting pieces 3 are symmetrically arranged at the opening. One end of each of the connecting pieces 3 is connected to the edge of the opening 11 of the main body 1, and the other end of each of the connecting pieces 3 can be connected to any position of the sealing cover member 2 except the center.

Of course, the number of the connecting pieces 3 can be greater. The connecting pieces 3 need to be evenly distributed at the opening 11 and the sealing cover member 2 must be centrally disposed on the opening 11. The sealing cover member 2 can be deformed to produce the openable and closeable opening 12 when subjected to pressure.

EMBODIMENT 3

Figure 7:
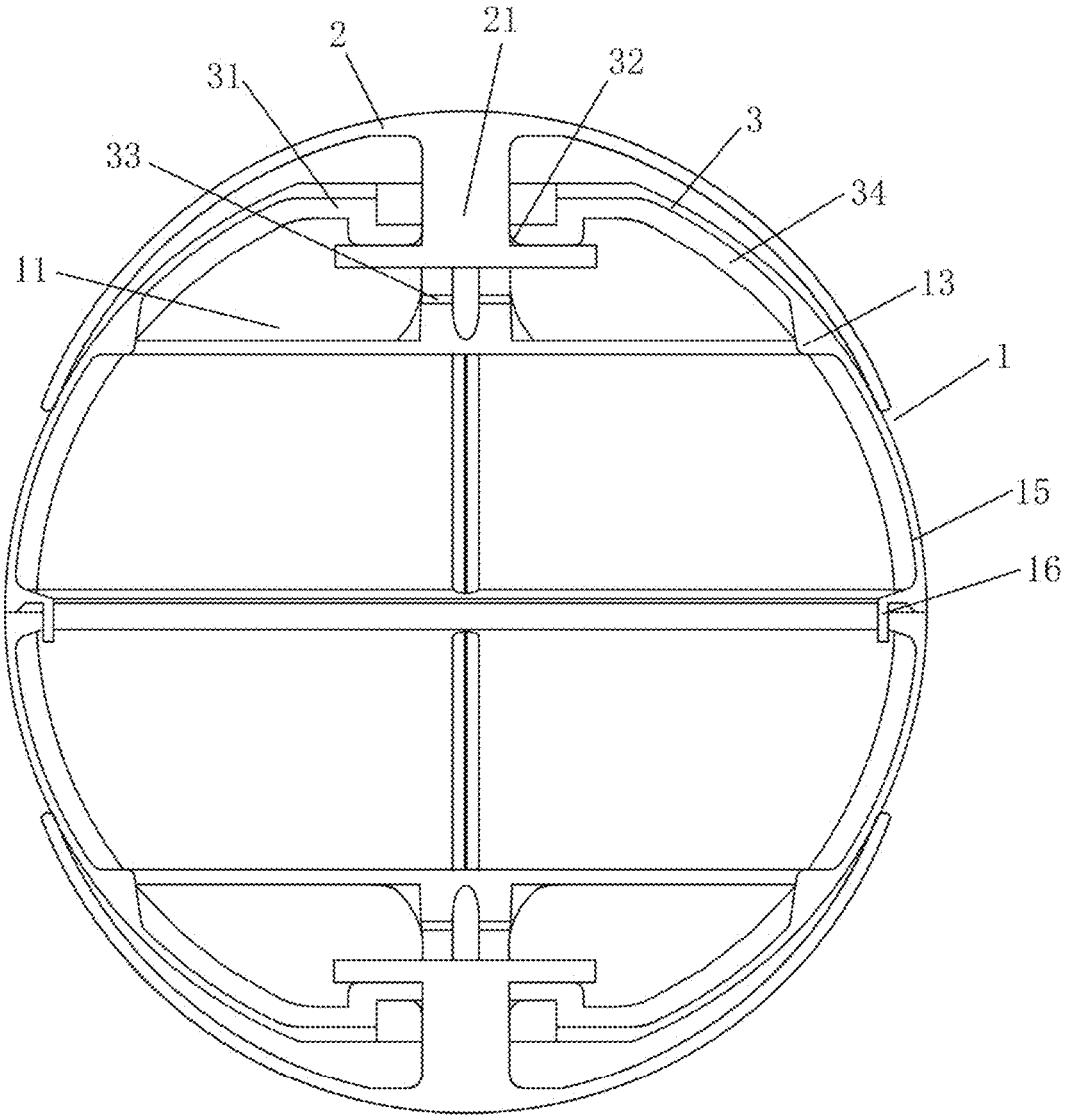
FIG. 7 is a schematic cross-sectional view of the structure of Embodiment 3 of the present application.

As shown in FIG. 7, the difference between this embodiment and Embodiment 2 is that the connecting member further includes a dome 31. The dome 31 is provided above and concentrically with the opening 11, and the sealing cover member 2 is fixedly connected to the dome 31. At least two of the connecting pieces 3 are arranged at equal angular intervals around the dome 31. One end of each of the connecting pieces 3 is connected to the opening 11 of the main body 1, and the other end of each of the connecting pieces 3 is connected to the dome 31.

The main body 1 and the plurality of connecting pieces 3 disposed on the opening 11 form a spherical structure as a whole. The plurality of connecting pieces 3 are disposed along the spherical contour of the main body 1. In other words, a portion of the hollow spherical body 1 is cut off by a cross section to form the opening 11. The connecting pieces 3 are provided on the opening 11 to make up for the missing portion of the spherical body 1. The connecting pieces 3 converge at the top of the main body 1 and connect to the dome 31, thereby improving the overall rigidity of the main body 1.

The sealing cover member 2 is fixedly connected to the dome 31. Of course, the shape of the sealing cover member 2 is similar to the part of the spherical body 1 cut off by the cross section H. The outer diameter of the sealing cover member 2 is larger than the diameter of the opening 11, so that the sealing cover member 2 can cover the opening 11 of the main body 1 in order to close it.

The dome 31 is provided with a through hole 32, and the sealing cover member 2 is provided with a nail anchor 21. The nail anchor 21 is passed through the through hole 32 so as to fixedly connect the sealing cover member 2 to the dome 31.

The nail anchor 21 is used to fix the sealing cover member 2 on the dome 31. The nail anchor 21 is arranged at the center of the sealing cover member 2. The dome 31 is provided with a through hole 32, and the sealing cover member 2 is arranged outside the dome 31. The nail anchor 21 can pass through the through hole 32 from the inside of the dome 31 and connect to the sealing cover member 2.

It is understandable that the sealing cover member 2 and the nail anchor 21 can be connected to the dome 31 by secondary molding. Alternatively, the nail anchor 21 can be a T-shaped end. An end cap is provided on the sealing cover member 2, and the end cap can be inserted into the through hole 32. The T-shaped nail anchor 21 is embedded in the end cap to form an interference fit with the through hole 32, so that the sealing cover member 2 is assembled on the dome 31. Of course, the sealing cover member 2 can be fixedly connected to the dome 31 by existing bonding, ultrasonic welding, etc.

The opening 11 is provided with an inwardly extending liner ring 13, and lower ends of the connecting pieces 3 are connected to the liner ring 13. The liner ring 13 is equivalent to increasing the inner wall thickness of the main body 1, making the strength at the opening 11 greater. This can reduce deformation of the main body 1 when subjected to pressure to prevent water leakage.

Furthermore, a foot 33 is provided between the lower ends of the connecting pieces 3 and the liner ring 13. The foot 33 can be arranged on the liner ring 13. This can improve the strength and stability of the connecting pieces 3 so that the sealing cover member 2 can better close the opening and maintain stability to reduce water leakage.

A first reinforcing rib 34 is provided on an inner sidewall of each of the connecting pieces 3, and the first reinforcing rib 34 is provided along a length direction of each of the connecting pieces 3. The connecting pieces 3 are used to construct the missing part of the opening 11 of the main body 1. The connecting pieces 3 plays a role in supporting the sealing cover member 2. The first reinforcing rib 34 improves the structural strength of the connecting pieces 3, and the stability of the sealing cover member 2 can be better ensured.

EMBODIMENT 4

Figure 8:
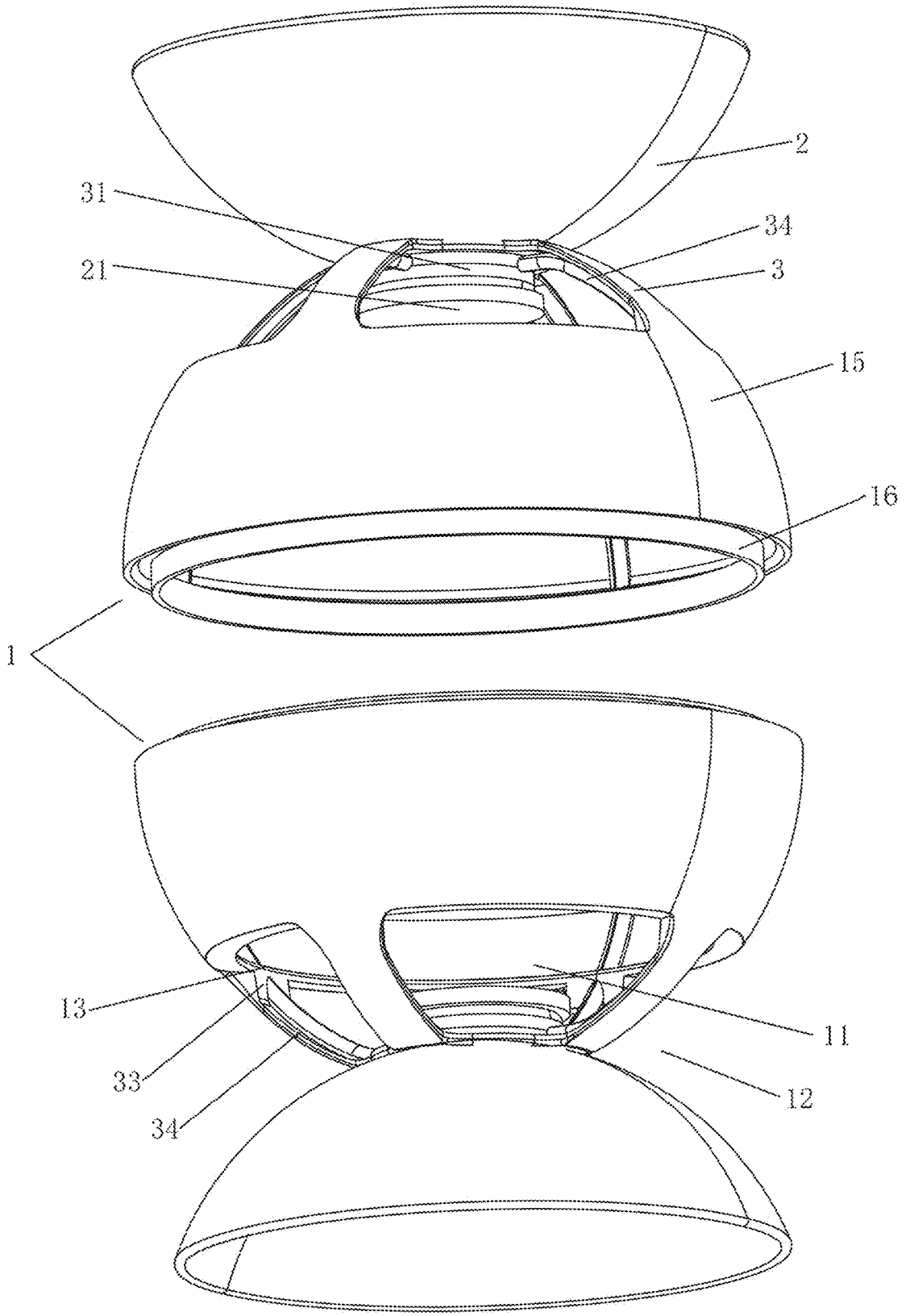
FIG. 8 is a schematic diagram of the structure of the disassembled state of Embodiment 4 of the present application.

As shown in FIG. 8, the difference between this embodiment and Embodiment 3 is that the main body 1 includes two hemispherical shells 15, and at least one of the hemispherical shells 15 is provided with the opening 11. Of course, both hemispherical shells 15 can be provided with the opening 11. The two hemispherical shells 15 are matched and connected to form the main body 1 which is spherical in shape. The main body 1 is divided into two hemispherical shells 15 for production, which is convenient for mold production and also convenient for assembly of the sealing cover member 2. Furthermore, the two hemispherical shells 15 can be fixedly connected by bonding or ultrasonic welding to form the main body 1.

An equatorial ring 16 is provided on an inner wall of the main body 1. The equatorial ring 16 is formed on one of the hemispherical shells 15. The equatorial ring 16 covers the connection seam between the two hemispherical shells 15, and the equatorial ring 16 is fixedly connected to the other one of the hemispherical shells 15 by a hot melting or bonding process. The equatorial ring 16 can improve the strength of the connection seam between the two hemispherical shells 15, thereby improving the overall strength of the main body 1.

The above description is only a preferred embodiment of the present disclosure. Therefore, all equivalent changes or modifications made according to the structure, characteristic and principle described in the scope of the present patent application are included in the scope of the present patent application.

What is claimed is:

1. A throwable exploding water ball, comprising a main body and a sealing cover member, characterized in that:

the main body is provided with at least one opening, the opening is in communication with an inner cavity of the main body;

the main body and the sealing cover member are both made of an elastic soft material, the sealing cover member is connected to the main body through a connecting member and seals the opening, so that the inner cavity of the main body is able to store water;

when the main body and/or the sealing cover member are deformed by an impact, an openable and closeable opening is formed between the main body and the sealing cover member, so that the water in the inner cavity of the main body is splashed out from the openable and closeable opening through the opening of the main body;

wherein the connecting member comprises at least two connecting pieces and a dome, the dome being provided above and concentrically with the opening of the main body, the sealing cover member being fixedly connected to the dome, one end of each of the connecting pieces being connected to the opening of the main body, and another end of each of the connecting pieces being connected to the dome.

2. The throwable exploding water ball according to claim 1, characterized in that: the at least two connecting pieces are arranged at equal angular intervals around the dome.

3. The throwable exploding water ball according to claim 1, characterized in that: the dome is provided with a through hole, the sealing cover member is provided with a nail anchor, the nail anchor is passed through the through hole, whereby the sealing cover member is fixedly connected to the dome.

4. The throwable exploding water ball according to claim 1, characterized in that: the connecting pieces and the main body are integrally formed.

5. The throwable exploding water ball according to claim 1, characterized in that: the opening is provided with an inwardly extending liner ring and lower ends of the connecting pieces are connected to the liner ring.

6. The throwable exploding water ball according to claim 5, characterized in that: a foot is provided between the lower ends of the connecting pieces and the liner ring.

7. The throwable exploding water ball according to claim 1, characterized in that: a first reinforcing rib is provided on an inner sidewall of each of the connecting pieces, and the first reinforcing rib is provided along a length direction of each of the connecting pieces.

8. The throwable exploding water ball according to claim 1, characterized in that: a plurality of second reinforcing ribs are provided on the main body, and the plurality of second reinforcing ribs are disposed around the main body in sequence and at intervals.

9. The throwable exploding water ball according to claim 1, characterized in that: the main body comprises two hemispherical shells, at least one of the hemispherical shells is provided with the opening, and the two hemispherical shells are matched and connected to form the main body which is spherical in shape.

10. The throwable exploding water ball according to claim 9, characterized in that: an equatorial ring is provided on an inner wall of the main body, the equatorial ring is formed on one of the hemispherical shells, the equatorial ring covers a connection seam between the two hemispherical shells, and the equatorial ring is fixedly connected to another one of the hemispherical shells by a hot melting or bonding process.

11. The throwable exploding water ball according to claim 1, characterized in that: the main body has a cross-section H intersecting therewith, the opening is opened on the main body along the cross-section H; the cross-section H is parallel to a horizontal reference plane, a distance between the cross-section H and the horizontal reference plane is less than a diameter of the main body, and the distance between the cross-section H and the horizontal reference plane is greater than or equal to a radius of the main body.

12. The throwable exploding water ball according to claim 1, characterized in that: the sealing cover member is a circular disc structure, an arc height L is provided between an edge of the sealing cover member and its center, and a diameter of the sealing cover member is greater than a diameter of the opening.

* * * * *